US011382445B2

(12) United States Patent
Quastad

(10) Patent No.: US 11,382,445 B2
(45) Date of Patent: Jul. 12, 2022

(54) PORTABLE DROP BOX

(71) Applicant: Randy Quastad, Estherville, IA (US)

(72) Inventor: Randy Quastad, Estherville, IA (US)

( * ) Notice: Subject to any disclaimer, the term of this patent is extended or adjusted under 35 U.S.C. 154(b) by 175 days.

(21) Appl. No.: 16/831,001

(22) Filed: Mar. 26, 2020

(65) Prior Publication Data

US 2021/0298505 A1 Sep. 30, 2021

(51) Int. Cl.

| | |
|---|---|
| ***A47G 29/20*** | (2006.01) |
| ***A47G 29/124*** | (2006.01) |
| ***A47G 29/22*** | (2006.01) |
| ***B65D 8/00*** | (2006.01) |

(52) U.S. Cl.

CPC ..... *A47G 29/124* (2013.01); *A47G 29/20* (2013.01); *A47G 29/22* (2013.01); *B65D 15/22* (2013.01); *B65D 15/24* (2013.01); *A47G 2029/1257* (2017.08)

(58) Field of Classification Search

CPC ..... A47G 29/124; A47G 29/22; A47G 29/20; A47G 29/141; A47G 29/16; A47G 2029/1257; A47G 2029/144; A47G 2029/148; B65D 15/22; B65D 15/24; B65D 7/14; B65D 7/26; B65D 7/28; B65D 7/30; B65D 7/32; B65D 21/086

USPC ..... 232/17, 19, 38, 45; 220/6

See application file for complete search history.

(56) References Cited

U.S. PATENT DOCUMENTS

| | | | | |
|---|---|---|---|---|
| 1,673,769 | A * | 6/1928 | Graham | G07C 13/02 220/6 |
| 4,783,978 | A | 11/1988 | Vallerga | |
| 6,186,662 | B1 | 2/2001 | Jackson | |
| 6,463,771 | B1 | 10/2002 | Judge | |
| 8,358,199 | B2 | 1/2013 | Nesling | |
| 9,926,108 | B2 | 3/2018 | Wiley et al. | |
| 10,143,321 | B2 * | 12/2018 | Hippert | A47G 29/20 |
| 10,180,016 | B2 | 1/2019 | Critz | |
| 10,321,780 | B1 * | 6/2019 | James | A47G 29/141 |
| 10,537,196 | B1 * | 1/2020 | MacPherson | A47G 29/141 |
| 10,537,197 | B2 | 1/2020 | Hopp | |
| 10,696,453 | B2 * | 6/2020 | Sena | A47G 29/141 |
| 10,709,276 | B2 * | 7/2020 | Guanch | A47G 29/20 |
| 10,743,694 | B2 * | 8/2020 | Raphael | A47G 29/20 |
| 10,743,695 | B1 * | 8/2020 | Altmaier | B60R 9/065 |
| 10,786,103 | B2 * | 9/2020 | Teoh | B65D 11/1853 |
| 11,116,345 | B2 * | 9/2021 | Sankaran | B65D 5/3635 |
| 11,206,939 | B2 * | 12/2021 | Sundaresan | A47G 29/124 |
| 2012/0269461 | A1 * | 10/2012 | Proctor | G09F 23/00 383/42 |
| 2016/0068306 | A1 * | 3/2016 | Heinz | A47G 29/141 220/6 |
| 2017/0127868 | A1 * | 5/2017 | Adewuyi | A47G 29/22 |
| 2017/0188737 | A1 * | 7/2017 | Hippert | A47G 29/20 |
| 2019/0350398 | A1 * | 11/2019 | Raphael | A47G 29/141 |
| 2020/0015616 | A1 * | 1/2020 | Sankaran | B65D 5/3635 |
| 2020/0107663 | A1 * | 4/2020 | Eivaz | A47G 29/20 |

* cited by examiner

*Primary Examiner* — William L Miller

(74) *Attorney, Agent, or Firm* — Nyemaster Goode P.C.

(57) ABSTRACT

Illustrative embodiments of systems and methods for protecting delivered packages from being stolen are disclosed. The invention described a portable drop box in which to place a delivered package that is weather-proof box and which has sides, a bottom, and a top that includes a lid for easy access to the contents of the box. The box is further collapsible or foldable for easy storage.

7 Claims, 4 Drawing Sheets

PORTABLE DROP BOX

TECHNICAL FIELD

The present disclosure relates, generally, to a portable box in which to place deliveries.

BACKGROUND

Through the years, people have begun shopping online more and more frequently. The surge of online shopping results in the delivery of millions of packages to homes and businesses each day. Many of these packages, unfortunately, are stolen or disappear without explanation. In fact, it has been estimated by transportation experts that about 15 percent of all deliveries in urban areas fail to reach customers on the first attempt because of package theft and other issues, such as delivery to the wrong house. In suburbs and rural areas, thieves often follow delivery trucks and snatch just-delivered packages from homes, often out of sight of neighbors.

Online shoppers have turned to a variety of strategies to ward off and discourage thieves. Some of these strategies include the use of video doorbells and package tracking services. While these tools are useful in locating and seeing packages, they are not helpful in preventing thieves from physically taking the packages.

There is therefore a need in the art for the present invention.

SUMMARY

The present invention relates to a portable drop box for use in storing and protecting delivered packages and groceries. The drop box primarily serves as a means of sheltering these items from thieves who might otherwise see the packages and attempt to steal, while also protecting the items from the weather, animals, and other threats to the contents of the packages between the time the packages are delivered and the owner retrieving the items from outside.

The box is weather-safe and designed to keep the packages within out of sight. The box has sides, a top, and a bottom and is of a size large enough to hold most packages. The box is preferably made of a weather-safe material and may optionally be weighted to keep the box from blowing away or being easily stolen. In addition, the box may include means to tether the box to a stationary object to further secure the box to the deck or step on which it sits. In certain embodiments, the box has at least one handle on the lid or other portion of the box to enable access by the user to the interior of the box and/or assist with movement of the box. The box includes latches or other means to secure the box shut and protect its contents. The box may further include a lock or other additional security device which may be programmed or design to be opened only by designated users. In certain embodiments, the box may include features such that it can be collapsed similar to a tent, using poles, rods, folds, creases, or like means. Once collapsed or folded, the box may be stored or transported by the owner.

BRIEF DESCRIPTION OF THE DRAWINGS

The detailed description particularly refers to the following figures, in which.

Figure 1:
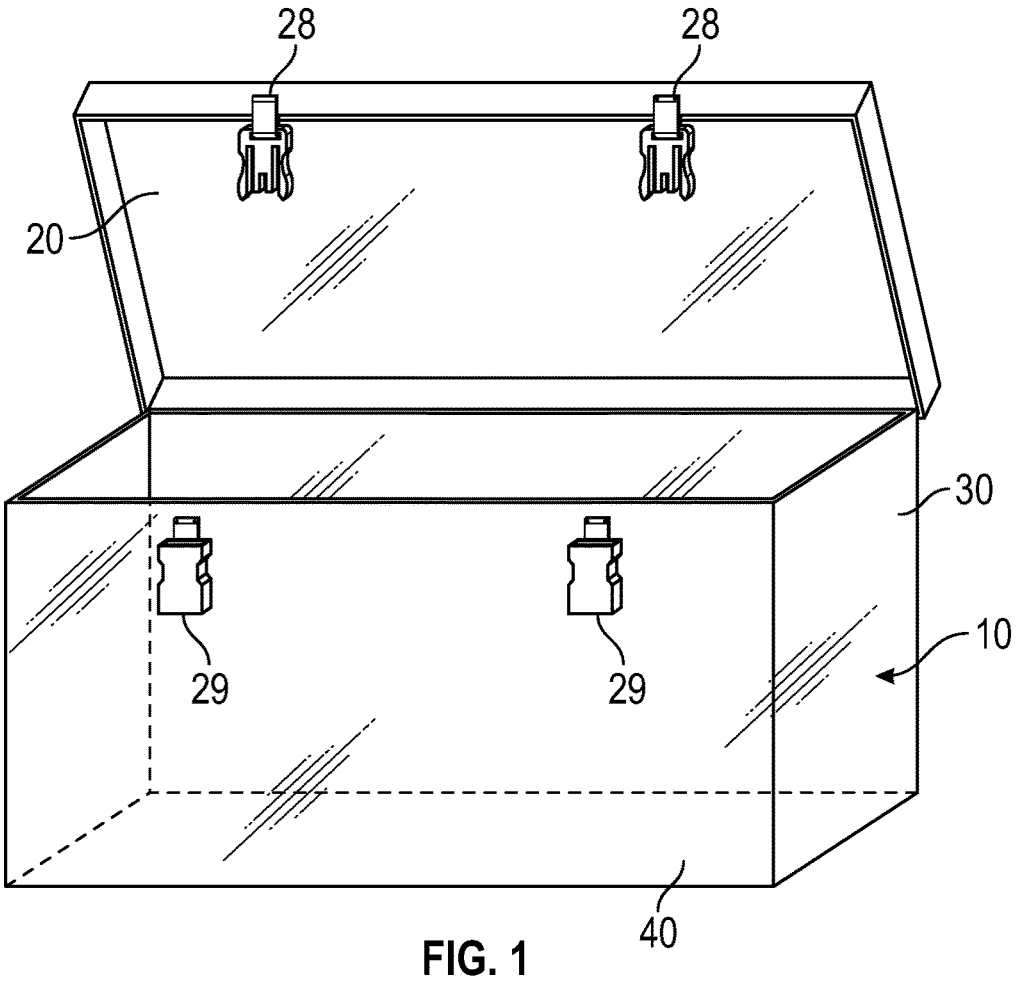
FIG. 1 is a perspective view of the drop box of the invention shown in open format.

Where considered appropriate, reference labels have been repeated among the figures to indicate corresponding or analogous elements.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Figure 2:
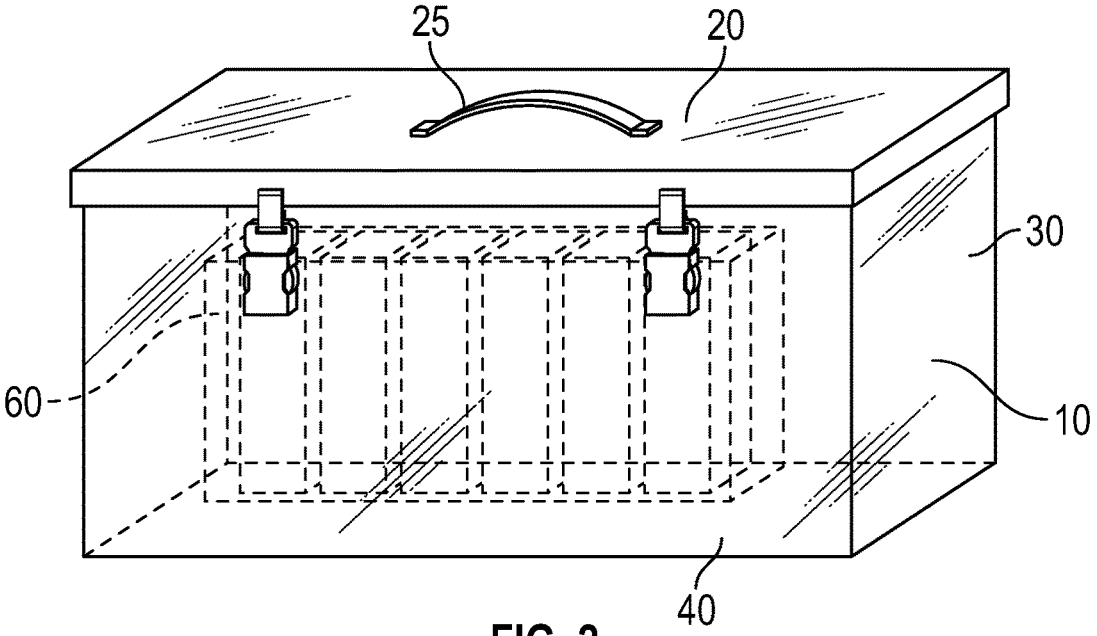
FIG. 2 is a perspective view of the drop box of the invention shown in closed format with a delivered package inside.
Figure 3:
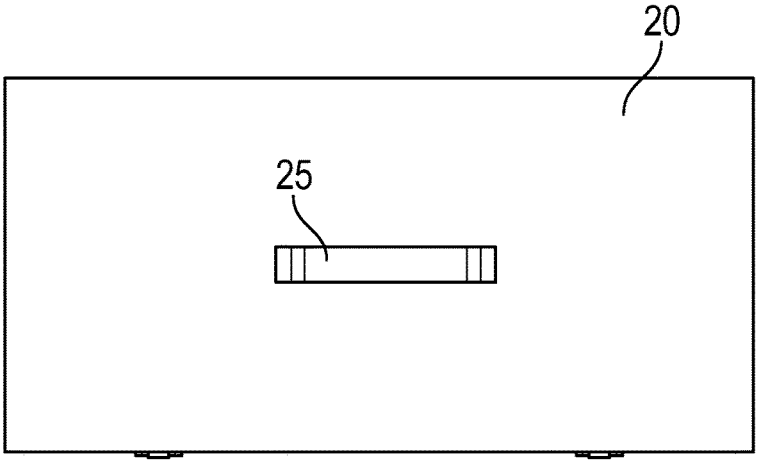
FIG. 3 is a top elevational view of the drop box of the invention.
Figure 4:
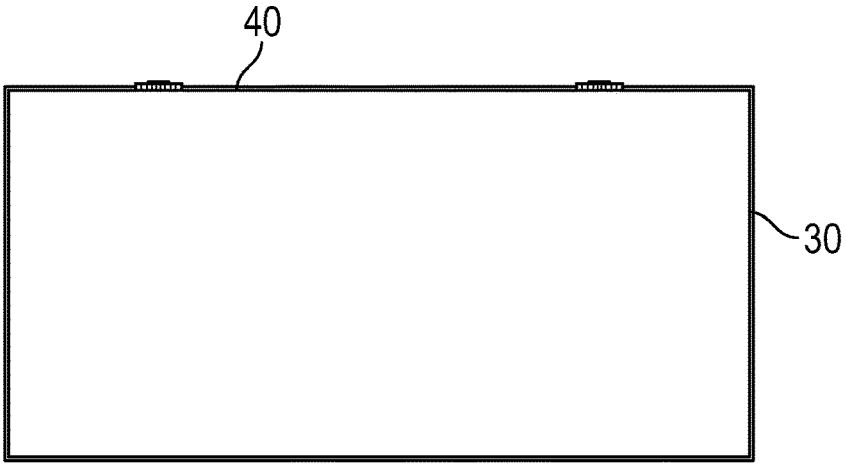
FIG. 4 is a bottom elevational view of the drop box of the invention.
Figure 5:
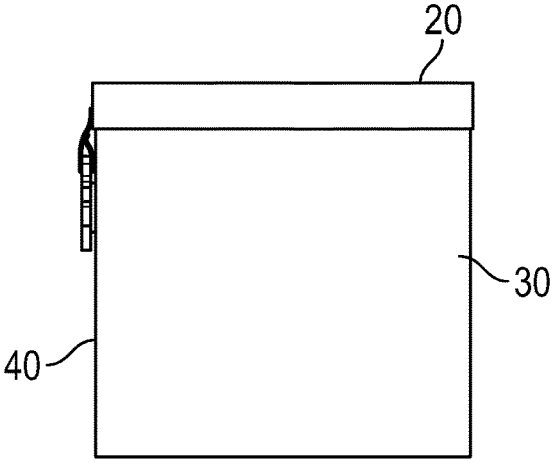
FIG. 5 is a side view of the drop box of the invention.

The portable drop box of the invention 10 is shown in the figures. FIG. 1 shows the portable drop box 10 having a lid 20, walls 30 and a bottom 40. The box 10 is designed to sit outside of a home on a porch, front step, or deck, and is intended to hold a package 60 delivered to the home, as shown in FIG. 2. The box 10 can be of any size (i.e. 2'×4', 3'×5', 3'×6', etc.) or shape, such as rectangular, square, etc. depending upon a number of factors and preferences, including the size of the outside porch or other package delivery space, size of package(s) typically delivered to the resident, aesthetics, etc. The drop box 10 is preferably of a size large enough to hold most packages that are delivered, yet small enough so it preferably does not take up the entire porch or step on which it is placed.

In general, the drop box 10 can be of any color or ornamental design to match or coordinate with the house, depending upon the preference of the owner. However, the box should be designed in a manner such that the contents of the box cannot be seen from the outside, i.e. the box should not be clear or transparent. While the box 10 is described specifically as to its use as a storage device for delivered packages, based upon its features, as more fully described below, it may also be used as a tote for use in general storage, camping, traveling, etc.

The portable drop box 10 is preferably made of or covered with a weather-safe, water-repellant, water-resistant, or weatherproof material. Such materials are well known in the art and include, but are not limited to, PUL (polyurethane laminate), TPU (thermoplastic polyurethane), nylon, canvas, metal, polyester, PVC-coated polyester, laminated cotton/poplin, oilcloth, polyester fleece, microfiber, wool, vinyl, pleather, plastic, rubber, densely woven fabrics, Gore-Tex®, eVENT® fabric, neoprene, etc.

Figure 8:
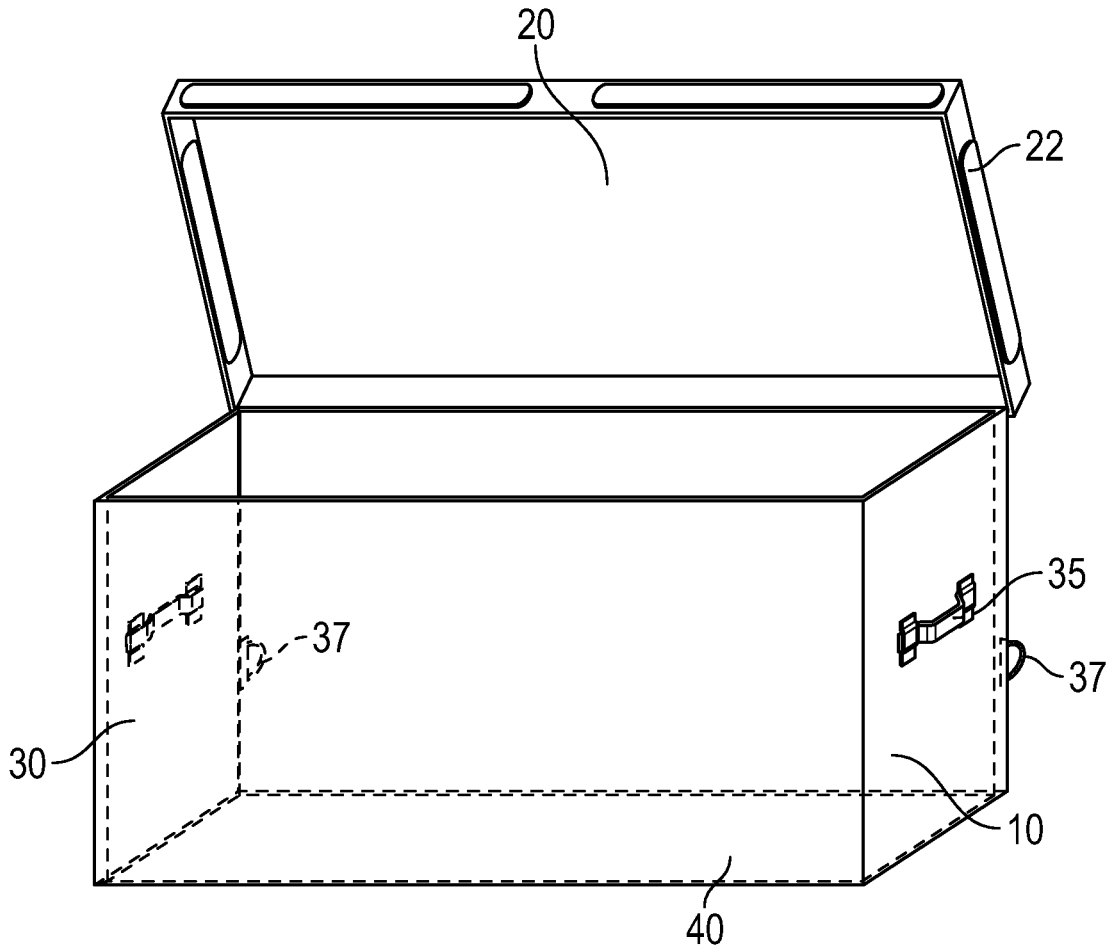
FIG. 8 is a perspective view of an alternate embodiment of the drop box of the invention which includes weights and side handles.

In one embodiment, the portable drop box 10 is weighted so that it does not blow off the porch or step where it is placed, such as with sewn-in weights 22 in the lid 20, as shown in FIG. 8. The weights 22 can be made of a variety of materials well known in the art including, but not limited to, plastic, metal, wood, plastic poly pellets, micro-glass beads, etc. As well as being sewn into the lid 20, the weights 22 and/or weighted material may be sewn in or otherwise attached to any other component of the box 10 including the sides 30, bottom 40, etc.

In another embodiment, the portable drop box 10 has means to tether the box to a stationary object using conventional means, such as D-rings 37 as shown in FIG. 8 or other types of hardware, such as pins, rings, or clips. The D-rings 37 or other suitable hardware can be used for looping or fastening rope, twine, bungee cords, chains, straps, etc. (not shown) through the rings 37 or other fastener. The rope or cord is then tied, clipped, looped through a corresponding D-ring or other hardware, or otherwise attached to a stationary object (not shown), such as a door, side of the house, rock etc. in order to secure the box 10 and help prevent the box 10 from being easily taken and/or from sliding or blowing around the porch or deck.

Figure 6:
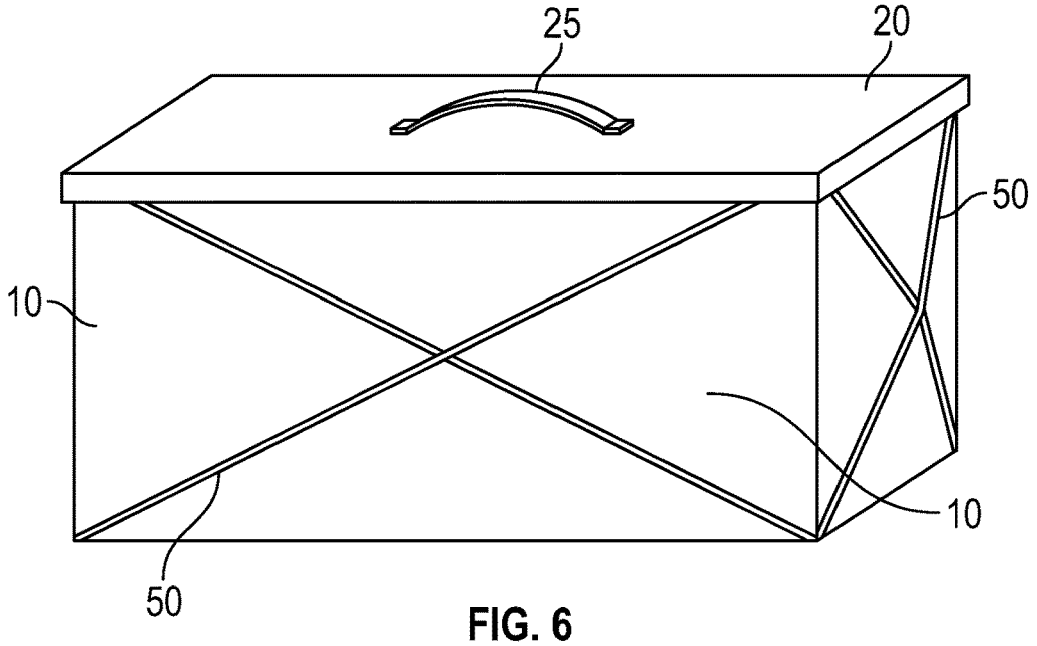
FIG. 6 is a perspective view of an alternate embodiment of the drop box of the invention which includes a lid handle and pushed out sides.

In one embodiment, the portable drop box 10 has at least one handle 25 on the lid 20 to enable easy opening and shutting of the lid 20 and allow convenient access to the interior of the box 10, as shown in FIG. 6. Likewise, the sides 30 of the box 10 may include grips or handles 35, as shown in FIG. 8, to assist the user with moving, sliding, or carrying the box 10. The bottom 40 of the box 10 may further include wheels or casters 27 as shown in FIG. 7 to further enable sliding or moving of the box 10 along the floor of the deck or porch.

In one embodiment, the portable drop box 10 is configured to latch shut in some manner, such as with well-known fasteners or closures including but not limited to snaps, latches, spring loaded toggle catch clips, spring loaded latch toggle hatch locks, other types of latches, buttons, zippers, etc. FIG. 1 shows one embodiment in this regard which includes press and pull locks 28 and receiving ends 29. The latches 28 or other closures both protect delivered packages inside the box from the weather, animals, etc., and further make it more difficult for others to access the inner contents of the box 10. The fasteners may further include a locking device 31, 33 (FIG. 7) or other device that may be secured such that it can only be opened by designated users, such as the home owner and the deliver person. Examples of such locking devices are well known in the art and include, but are not limited to, padlocks, cam locks, combination locks, etc. Alternatively, a locking device may be placed on the box 10 that is not attached to the fastener directly but simply placed on the box 10 in such a manner so as to prevent the lids 20 from opening without first unlocking the locking device.

Figure 7:
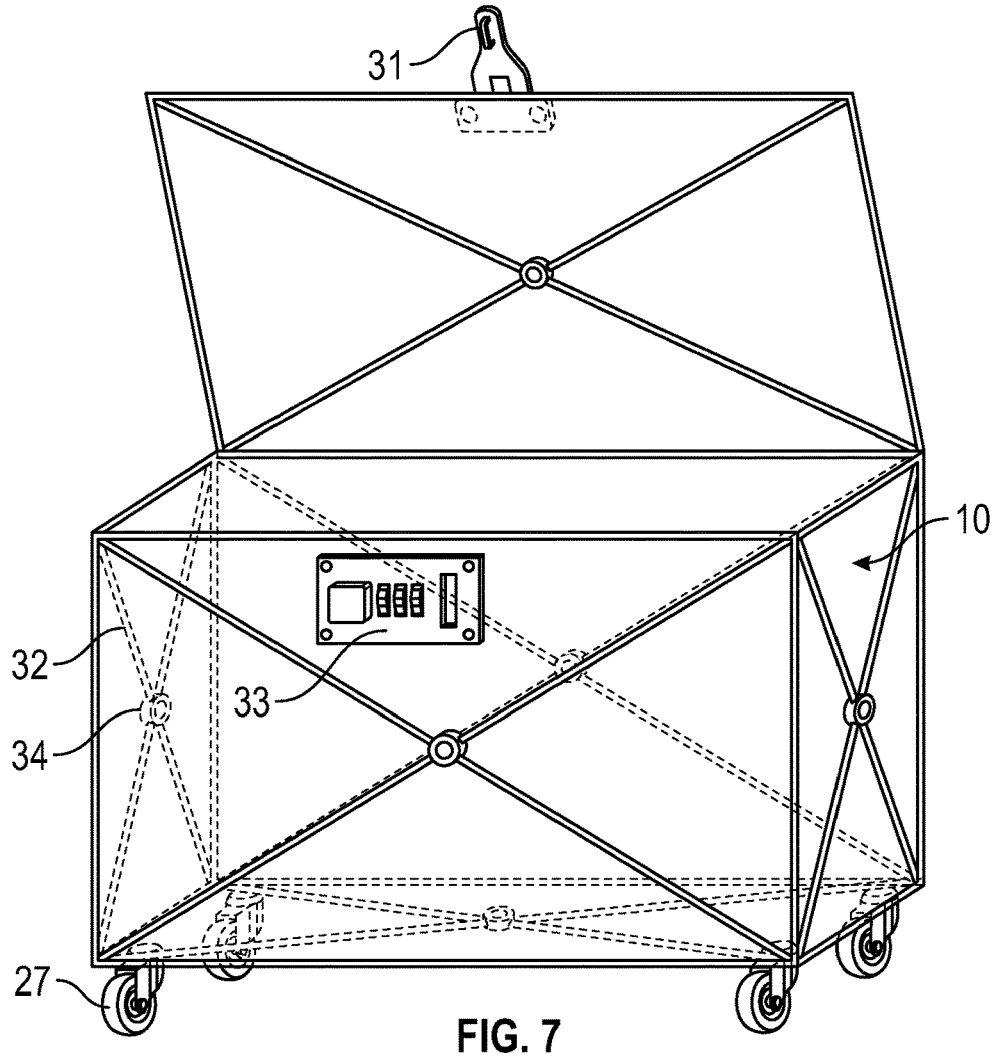
FIG. 7 is a perspective view of an alternate embodiment of the drop box of the invention which includes rods or poles in the sides and bottom.

In one embodiment shown in FIG. 7, the drop box 10 may be collapsible, similar to a canvas tent, whereby, for example, each side 30 of the box 10 has tent poles or fiberglass rods 32 with a center snap lock 34 that allow the rods 32 to "collapse" or fold in when the snap 34 is engaged by the user. In another embodiment shown in FIG. 6, the sides 30 of the box 10 have creases or folds 50 that can fold in a concave or convex manner to collapse or fold when the user pushes the creases or folds 50 in or out. The collapsed box (not shown) may then be stored by the owner in a portable bag (not shown), for example, or placed in the garage, for instance, when not in use.

In another embodiment, the portable drop box 10 of the invention includes other means of allowing it to collapse or fold up, including conventional tent poles (not shown) that may be inserted in the box 10 when the box 10 is to be used, then removed when the box 10 is ready to be stored if desired. Such poles are well known in the art and may be made of a variety of materials including, but not limited to, fiberglass, aluminum, carbon fibre, steel, plastic, inflatable, etc.

In general, the tent poles may be flexible and more lightweight and the more rigid poles are more robust and heavy-duty. The rigid poles are usually made of metal and include joint fittings. Sectional rigid poles are normally fixed together, usually with steel springs. Flexible poles can be bent to form arcs and are often made of glass reinforced plastic (GRP) or metal. Glass fiber poles typically have elastic running through the middle. Telescoping tent poles may also be used. The poles may be inserted or enclosed in pockets and/or threaded through slots in the sides 30, top 20, and/or bottom 40 of the box 10 to provide support in those portions of the box 10 then easily removed when the box 10 is ready to be stored in a bag or otherwise. Other collapsible mechanisms are well known in the art and are also included within the scope of the invention.

In practice, the drop box 10 is placed on the porch or step on the day a package 60 is expected to be delivered, or may be left out at all times if desired for frequent or unexpected deliveries. When the package 60 is delivered, the delivery person will place the package 60 in the box 10, whereby it is then protected from the weather elements and other threats until the resident returns home to retrieve the package 60. The box 10 also serves as protection of the package 60 within from animals that may disturb the contents of the package 60, or from thieves that might otherwise see the package 60 unattended and attempt to steal the package 60.

There are a plurality of advantages of the present disclosure arising from the various features of the systems, apparatus, and methods described herein. It will be noted that alternate embodiments of the systems, apparatus, and methods of the present disclosure may not include all of the features described yet still benefit from at least some of the advantages of such features. Those of ordinary skill in the art may readily devise their own implementations of the systems, apparatus, and methods that incorporate one or more of the features of the present disclosure and fall within the spirit and scope of the present invention as defined by the appended claims.

The invention claimed is:

1. A portable drop box comprising:

a box having closed sides, a closed bottom and a top, said top having a lid that can be shut to close the top of the box and protect contents in the box;

said box being weather-proof;

and further providing that the box is collapsible or foldable to allow the box to be easily stored or carried;

said box further comprising a collapsible mechanism, whereby the collapsible mechanism comprises poles or rods that are attached to or enclosed in one or more of the sides of the box;

and further providing that the collapsible mechanism includes a snap lock that causes the poles or rods to collapse or fold in when the snap lock is engaged.

2. The portable drop box of claim 1 whereby the box is comprised of or covered by a weather-proofing material selected from one or more of the group consisting of PUL (polyurethane laminate), TPU (thermoplastic polyurethane), nylon, canvas, metal, polyester, PVC-coated polyester, laminated cotton/poplin, oilcloth, polyester fleece, microfiber, wool, vinyl, pleather, plastic, rubber, densely woven fabrics, Gore-Tex®, eVENT® fabric, and neoprene.

3. The portable drop box of claim 1 whereby the poles or rods are comprised of a material selected from the group consisting of fiberglass, aluminum, carbon fibre, steel, and plastic.

4. The portable drop box of claim 1 further comprising at least one handle on the lid.

5. The portable drop box of claim 1 further comprising wheels or casters on the bottom of the box.

6. The portable drop box of claim 1 further comprising a locking mechanism.

7. A method of preventing theft of a delivered package comprising:

placing a portable drop box on a front porch or step, said box having closed sides, a closed bottom and a top, said top having a lid that can be shut to close the top of the box and protect contents in the box, and further providing that the box is weather-proof and collapsible or foldable;

said box further comprising a collapsible mechanism, whereby the collapsible mechanism comprises poles or rods that are attached to or enclosed in one or more of the sides of the box;

and further providing that the collapsible mechanism includes a snap lock that causes the poles or rods to collapse or fold in when the snap lock is engaged; and placing a delivered package in the box.

* * * * *